US008650820B2

(12) United States Patent
Bocquet et al.

(10) Patent No.: US 8,650,820 B2
(45) Date of Patent: Feb. 18, 2014

(54) METHOD FOR MANUFACTURING FIBROUS MATERIAL ASSEMBLIES TO PRODUCE SUPPORTING STRUCTURE, ASSEMBLIES PRODUCED BY SAID METHOD, AND STRUCTURE IMPLEMENTING SAID ASSEMBLIES

(75) Inventors: Jean-Francois Maurice Bocquet, Sanchey (FR); Pascal Andre Jean Toussaint, Moyenmoutier (FR)

(73) Assignee: Universite de Lorraine, Nancy Cedex (FR)

( * ) Notice: Subject to any disclaimer, the term of this patent is extended or adjusted under 35 U.S.C. 154(b) by 191 days.

(21) Appl. No.: 13/378,915

(22) PCT Filed: Jul. 1, 2010

(86) PCT No.: PCT/FR2010/051385

§ 371 (c)(1),
(2), (4) Date: Feb. 15, 2012

(87) PCT Pub. No.: WO2011/001119

PCT Pub. Date: Jan. 6, 2011

(65) Prior Publication Data

US 2012/0141706 A1 Jun. 7, 2012

(30) Foreign Application Priority Data

Jul. 1, 2009 (FR) ..... 09 54503
Jul. 10, 2009 (FR) ..... 09 54854

(51) Int. Cl.
*E04C 3/12* (2006.01)
*E04C 5/12* (2006.01)

(52) U.S. Cl.
USPC ..... 52/223.8; 52/745.19

(58) Field of Classification Search
USPC ..... 52/223.14, 223.8, 223.13, 223.12, 52/223.6, 745.19
See application file for complete search history.

(56) References Cited

U.S. PATENT DOCUMENTS 620,561 A * 3/1899 Bettendorf ..... 52/837
2,925,727 A * 2/1960 Harris et al. ..... 52/745.05
3,247,635 A * 4/1966 Burns ..... 52/223.13
4,173,857 A * 11/1979 Kosaka ..... 52/642

(Continued)

FOREIGN PATENT DOCUMENTS

FR 2 449 177 A1 9/1980
WO 93/14282 A1 7/1993

OTHER PUBLICATIONS

International Search Report, dated Dec. 3, 2010, from corresponding PCT application.

*Primary Examiner* — Christine T Cajilig
(74) *Attorney, Agent, or Firm* — Young & Thompson

(57) ABSTRACT

Method for manufacturing an assembly in a supporting structure, constituted by parts (7,8) made of a fibrous material forming an elongate element that is at least partially hollow (10), with a longitudinal axis of symmetry (9), delimiting an inner area (11) and a outer area (12), characterized in that it consists of achieving the densification on the two end portions (13) of the hollow element, in order to exert, on each of the two end portions of the elongate hollow element, outward tensile forces in opposite directions to each other along its longitudinal axis in order to create an axial prestressing force having a determined value, and to maintain the elongate hollow element in this prestressed condition during the installation of the assembly in the structure. Also described are the assemblies obtained by this method and the structures using such assemblies.

21 Claims, 7 Drawing Sheets

(56) References Cited

U.S. PATENT DOCUMENTS

| | | | | | |
|---|---|---|---|---|---|
| 4,275,537 | A | | 6/1981 | Pinson | |
| 4,393,637 | A | * | 7/1983 | Mosier | 52/644 |
| 4,967,534 | A | * | 11/1990 | Lines | 52/837 |
| 5,606,839 | A | * | 3/1997 | Baumann | 52/848 |
| 5,718,090 | A | * | 2/1998 | Wei-Hwang | 52/223.14 |
| 6,151,850 | A | * | 11/2000 | Sorkin | 52/223.13 |
| 7,159,366 | B2 | * | 1/2007 | Espinosa | 52/293.3 |
| 7,752,824 | B2 | * | 7/2010 | Brown et al. | 52/745.21 |
| 7,823,345 | B1 | * | 11/2010 | Sorkin | 52/223.13 |
| 7,886,490 | B2 | * | 2/2011 | Maekawa et al. | 52/223.14 |
| 7,950,196 | B1 | * | 5/2011 | Sorkin | 52/223.13 |
| 8,087,204 | B1 | * | 1/2012 | Sorkin | 52/223.13 |
| 2002/0157333 | A1 | * | 10/2002 | Kadotani et al. | 52/223.2 |
| 2004/0148882 | A1 | * | 8/2004 | Hayes | 52/223.14 |
| 2004/0159058 | A1 | * | 8/2004 | Gulbenkian | 52/223.14 |
| 2008/0302035 | A1 | * | 12/2008 | Shin | 52/223.13 |
| 2009/0178352 | A1 | * | 7/2009 | Huff et al. | 52/223.8 |
| 2012/0297694 | A1 | * | 11/2012 | Kim et al. | 52/1 |

* cited by examiner

Fig.1
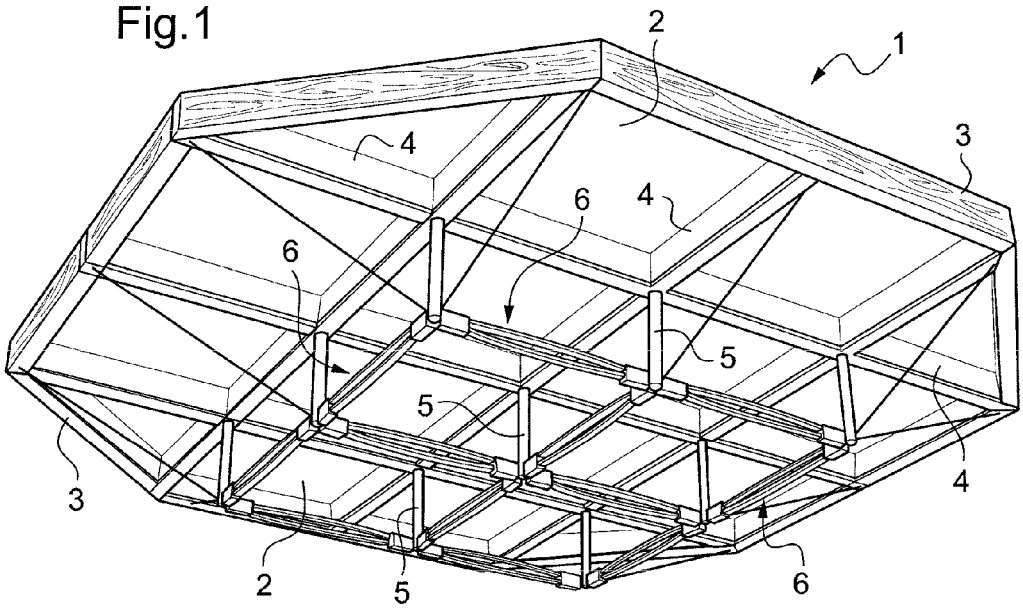
Fig.2
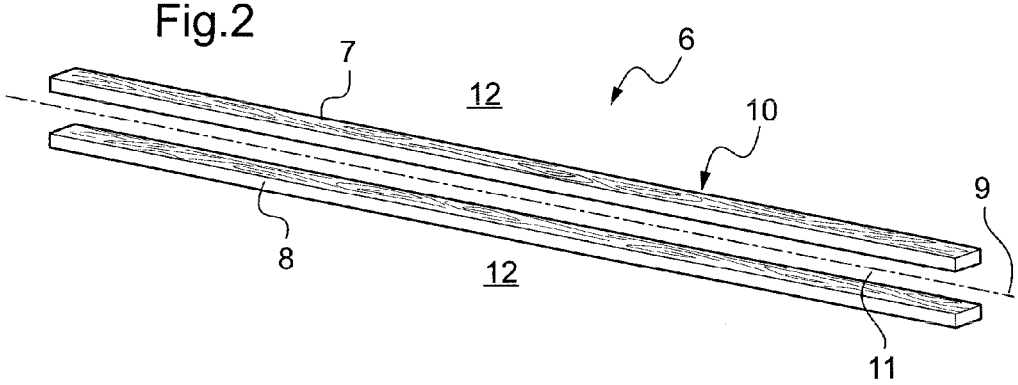
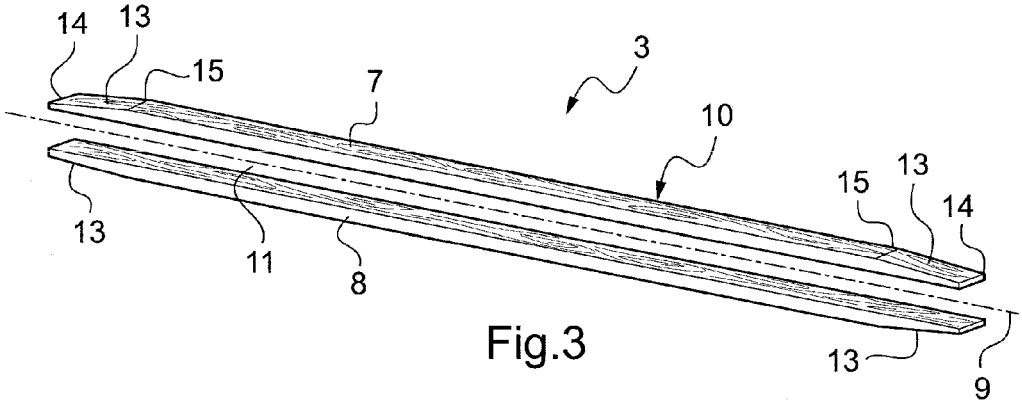
Fig.3

Fig.4
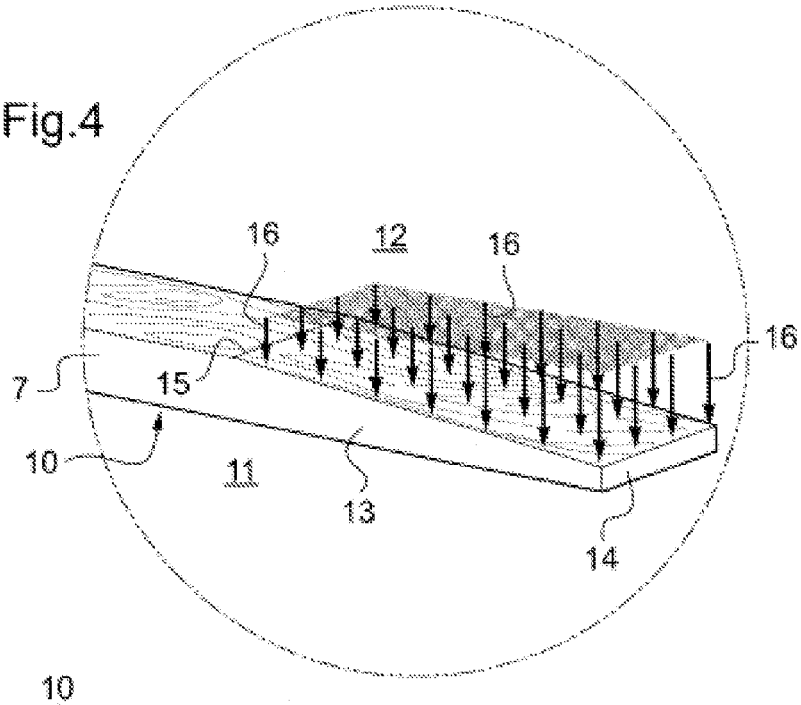
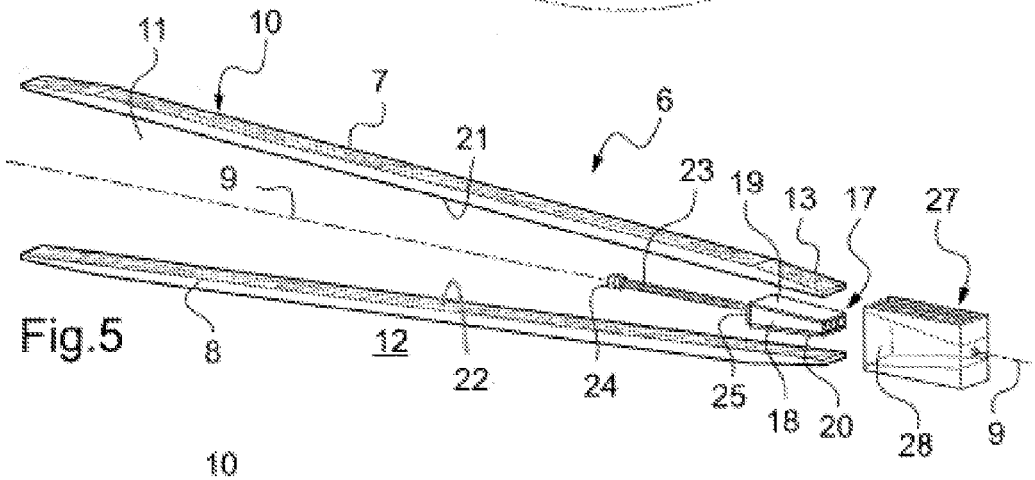
Fig.5
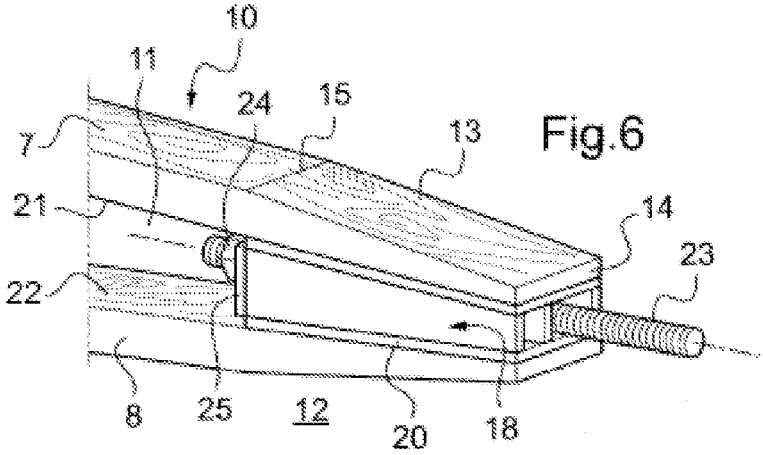
Fig.6

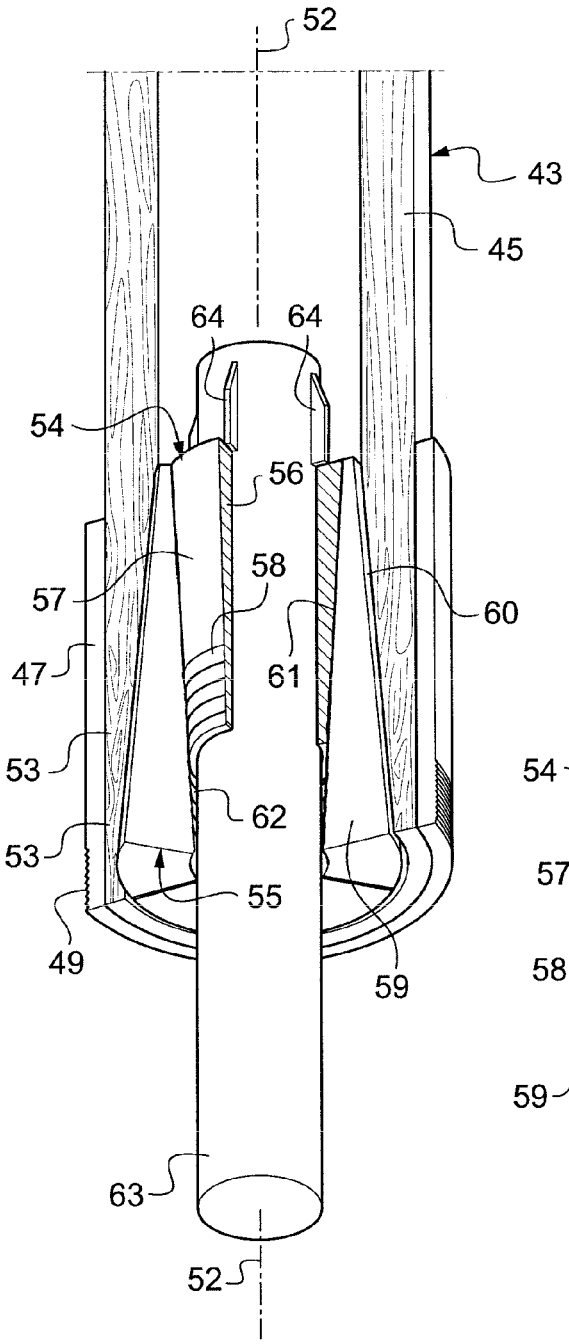
Fig.16
Fig.17
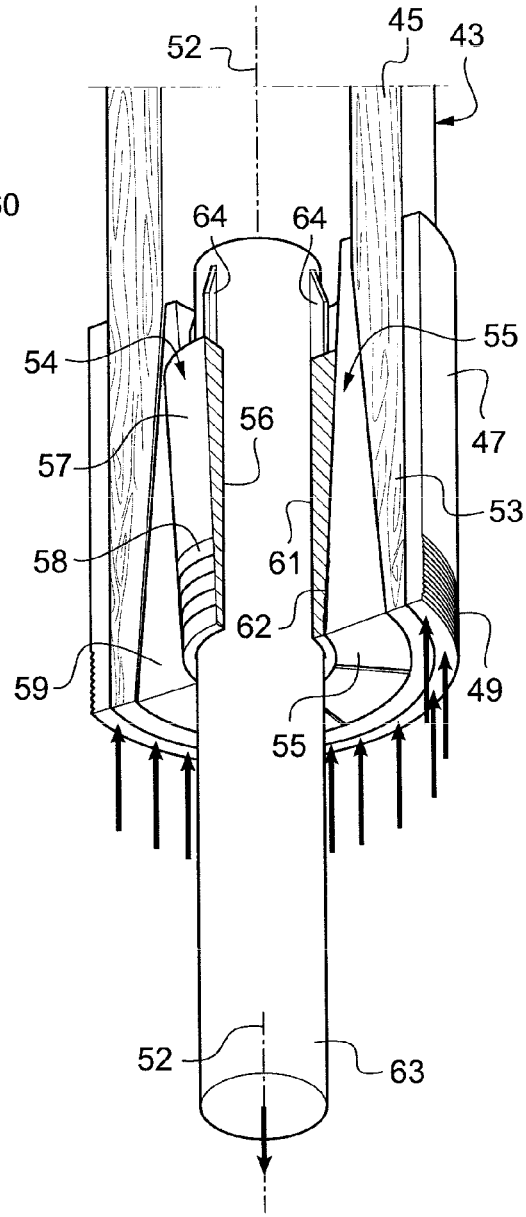

METHOD FOR MANUFACTURING FIBROUS MATERIAL ASSEMBLIES TO PRODUCE SUPPORTING STRUCTURE, ASSEMBLIES PRODUCED BY SAID METHOD, AND STRUCTURE IMPLEMENTING SAID ASSEMBLIES

The present invention relates to a method for manufacturing assemblies for connecting, supporting or other purposes, formed from a fibrous material, such as in particular wood or bamboo, used in the production of a structure for a building or any construction whatever of the frame or any other infrastructure element type, or also for street furniture, furnishings, etc.

The invention also relates to assemblies obtained by this method as well as structures using such assemblies suitably connected together or to other elements involved in the design and production of these structures.

Fibrous materials are plentiful in the natural environment, such as wood in its varied species or also some plants such as bamboo, which is a ligneous grass capable of very quickly producing hollow, relatively strong stems or culms over a short period of time, which can have a very significant longitudinal dimension with separations or knots distributed along its length and used in varying forms since time immemorial in the field of architecture, in particular for forming parts and also elements for assembling these parts, employed in the production of supporting or other structures for various constructions, owing to their mechanical characteristics, which are intrinsically beneficial for withstanding forces exerted in particular directions in relation to these parts, and also for aesthetic or even ecological reasons.

However, despite their generally favourable mechanical properties, in particular owing to their anisotropism, i.e. their different characteristics according to the direction of a force to which these parts made of fibrous material are subjected, said parts prove difficult to assemble by conventional means of the screw, rivet, pin, bracket or other type, which pass at least partially through the parts concerned; owing to the mechanical strength of said parts which varies significantly and is in particular generally very high under tension along the direction of their fibres, but conversely very low in transverse tension and in shear, perpendicular to this direction.

Producing assemblies of parts using such fibrous materials, in particular wood, to form structural elements of a construction using suitable connecting means imposes constraints as a result both of longitudinal tensile forces, which can be perfectly absorbed by the material usually up to a very high limit, and also of discontinuous and tangential parasitic forces applied to the elements of these assemblies in the plane of the faces of these parts, leading to damaging deformation thereof and ending with premature failure of the assembly following the formation of cracks at the level of the connecting means, opening up in the direction of the shear force applied, perpendicular to the longitudinal tensile force.

The present invention relates to a method that overcomes the drawbacks of the standard methods using assemblies of parts made of fibrous materials, by making possible a particularly marked reduction in the effects of the transverse shear forces which, in the event are exerted discontinuously on the parts forming the assembly when these are connected together or to other elements of the structure to be produced, this method providing assemblies with a high mechanical performance, the stiffness of which is moreover improved, limiting the possible relative movements of the parts within the assemblies of a single structure while giving them an increased capacity for energy dissipation in the event of seismic impact in particular.

To this end, the method in question for manufacturing an assembly of this type capable of use in the production of a supporting structure, said assembly being constituted by parts made of a fibrous material forming an elongate element that is at least partially hollow, with a longitudinal axis of symmetry, delimiting an inner area and an outer area, is characterized in that it consists of producing a localized densification of the fibrous material on the two end portions of the elongate hollow element, exerting, simultaneously with or following this densification, on each of the two end portions of the elongate hollow element, outward tensile forces in opposite directions to each other along its longitudinal axis in order to create an axial prestressing force having a determined value, and maintaining the elongate hollow element in this prestressed condition during the installation of the assembly in the structure.

Preferably, the densification of the fibrous material is achieved according to a mechanical process capable of reducing or even removing the cell voids in the material, obtained by means of a radial compressive force exerted on each of the two end portions of the elongate hollow element in a direction perpendicular to its longitudinal axis.

Advantageously, the compressive force exerted varies in intensity according to the length of each end portion, being maximal at the free end of the elongate hollow element and minimal at a distance therefrom, according to the length of this portion.

Preferably, the compressive force exerted has a gradient that increases evenly along the length of each end portion of the hollow element.

In a variant embodiment, the densification of the fibrous material is achieved by reducing its porosity following the forced injection of a polymer or other similar substance into said material in each of the two end portions of the elongate hollow element.

Advantageously, the densification of the fibrous material can be achieved by a combination of a compressive force and the injection of a polymer.

According to a further characteristic of the method in question, the prestressing force in each of the end portions of the elongate hollow element is achieved by placing on the one hand an inner connecting member having a generally conical shape in close contact with the elongate hollow element in the inner area, the member being firmly fixed using means suitable for exerting an outward tensile force along the longitudinal axis of the element, and on the other hand, a fixed hollow casing surrounding the element in its outer area while being immobilized with respect thereto, such that the longitudinal movement of the inner connecting member in the inner area under the effect of the axial tensile force, by cooperating with the fixed casing in the outer area, creates an increasing prestressing of the fibrous material that grows with this force, the locking together of the connecting member with the casing then being assured, in order to maintain the prestressing at the value thus attained.

The assembly produced by the use of this method can correspond to a large number of variant embodiments, the common or particular characteristics of which also form part of the present invention.

In a first embodiment, the elongate hollow element made of fibrous material uses two square-edged parts in the form of identical planar wooden boards or battens, spaced apart, substantially parallel to each other over the greater part of their length and symmetrical to each other with respect to the longitudinal axis of the element, the end portions of these two boards being brought towards each other and each having a preferably progressive narrowing owing to the force exerted on these portions in order to achieve their densification by mechanical compression and/or forced injection of a polymer, the inner connecting member having the shape of a pyramidal wedge, cooperating with a tension rod arranged along the longitudinal axis of the element in order to allow the prestressing force to be exerted on the wedge, this pyramidal wedge comprising two opposite planar faces in contact with the opposite faces of the end portions of the two boards directed towards the inner area, the fixed hollow casing surrounding the end portions of the two boards in the outer area comprising an open end for the element to be inserted and a base plate opposite this open end closing the casing at the tip of each of its end portions.

According to a particular feature of this first embodiment, the base plate of the casing has a bore in the longitudinal axis of the element for the tension rod of the pyramidal wedge to pass through.

According to a further characteristic, the end of the tension rod is threaded and cooperates with a nut that locks the casing relative to the pyramidal wedge in order to maintain the prestressing created on the assembly as a result of the tensile force exerted on said wedge along the longitudinal axis of the element.

Advantageously, the fixed casing comprises stiffening ribs on its inner surface in contact with the faces of the end portions of the two boards of the element directed towards the outer area, which extend preferably parallel and perpendicular to the longitudinal axis of said element.

In a variant embodiment, the hollow casing is produced using a metal sheet, shaped to surround the end portions of the two boards of the element, suitable for being pressed externally in order to crimp it to the pyramidal wedge forming the inner connecting member, in order to maintain the prestressing created on the assembly.

In another embodiment according to the invention, the elongate hollow element is constituted by a tube made of wood, preferably obtained by the so-called "glue-laminated" technique, having end portions predensified by mechanical compression and/or forced injection of a polymer, the inner connecting member being constituted by a stiff wedge having a conical or tapered shape, with an axial through-hole, the wedge capable of being engaged and moved along the longitudinal axis of the element within the cylindrical bore of a radially expandable intermediate sleeve and forcibly inserted therein in order to create, via the movement of the wedge along the axis, the prestressing force exerted on the end portions of the wooden tube, the fixed casing being formed of a metal ring surrounding the outside of the tube in the end portions.

Preferably, in this same embodiment, the radially expandable intermediate sleeve is formed of adjacent independent strips, delimiting the cylindrical bore of this sleeve and suitable for radial expansion under the effect of the movement of the stiff wedge in the cylindrical bore along the longitudinal axis of the element, creating the prestressing force.

Advantageously, the end of the conical wedge comprises circular grooves, arranged in its outer surface in planes perpendicular to the longitudinal axis, said grooves forming successive notches for locking said wedge relative to the intermediate sleeve by cooperating with similar grooves provided in the adjacent strips of this sleeve, opposite the wedge.

According to a further characteristic, the movement of the conical wedge in the intermediate sleeve is produced by means of a cylindrical plunger, capable of sliding in the axial through-hole passing through the wedge and comprising at the end bearing lugs suitable for exerting an axial force on this wedge, causing the prestressing of the end portions of the tube by engaging the wedge in the radially expandable sleeve.

Preferably, the plunger lugs can be retracted within it, in order to allow its withdrawal from the wedge, after the prestressing force has been achieved.

The metal ring forming the fixed outer casing usefully comprises a threaded end forming a screw suitable for cooperating with a similar thread forming a nut provided in an adjacent tube, arranged in the longitudinal axis of the hollow tube of the element, connecting the two tubes in the assembly.

In a third variant embodiment, the elongate hollow element is constituted by a bamboo tube, the end portions of which are split longitudinally and significantly tapered towards the longitudinal axis, in order to give the tube in these portions a conical shape where the bamboo is densified, the prestressing of the tube being achieved, preferably simultaneously with the densification, by the cooperation of a conical wedge engaged in the inner area of the element at the level of each end portion, and a fixed outer casing, also conical, surrounding this end portion, the wedge comprising an axial tension rod suitable for creating the prestressing force in the bamboo tube while simultaneously increasing its densification.

Other characteristics of the method in question and of an assembly obtained by this method will become more apparent through the following description of various embodiments, given by way of illustration and non-limitatively, with reference to the attached drawings in which:

FIG. 1 is a diagrammatical perspective view of a supporting structure, in particular for a trussed floor using assemblies according to the invention, produced with suitably prestressed elements made of fibrous materials.

FIGS. 2 to 8 relate to a first embodiment of such an assembly, showing a perspective view of the parts, here made of wood and square-edged, which form the hollow element of said assembly, these parts being given in separate views (FIGS. 2 to 4) then together (FIG. 5) for the purposes of their installation in the element; FIG. 6 showing a larger-scale perspective view of the inner connecting member combined with the element, and FIGS. 7 and 8, the fixed casing making it possible to achieve the prestressing of the ends of said element.

FIG. 9 is a perspective view of a variant of the previous embodiment with respect to the fixed casing used.

FIG. 10 on the one hand, and FIG. 11 on a slightly smaller scale on the other hand show another embodiment, also in external and perspective views respectively, another embodiment in which the hollow element of the assembly is a cylindrical wooden tube, the inner connecting member combining a stiff conical wedge and an expandable intermediate sleeve.

FIGS. 16 and 17 are larger-scale perspective views, with partial cutaway, giving details of the method of positioning the inner connecting member in the wooden tube of the hollow element in order to achieve the prestressing of the end portion of said tube.

Figure 7:
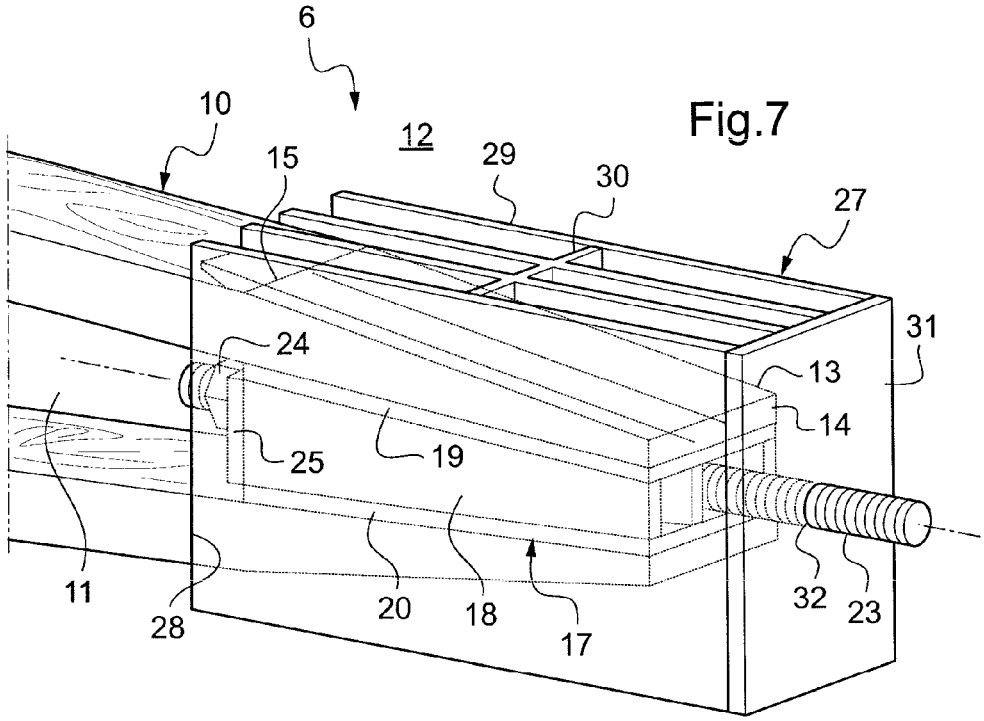

In FIG. 1, in a diagrammatic perspective view reference 1 shows the essential parts of a supporting structure, here a trussed floor, comprising a platform 2, made from a single block or formed of slabs or horizontal battens (not shown), the platform being surrounded by a lateral girdle 3 and resting on a set of intersecting supporting joists 4, from which extend vertical stiffening tie beams 5, distributed at the level of the intersecting points of the joists.

Between the tie beams 5, the structure is combined and connected by any suitable standard means that therefore need not be described herein, to connecting assemblies 6 extending transversally beneath the platform 2, parallel thereto or not, intended to absorb the bending or tensile forces exerted on the structure during its use, in particular, thus being subject to transverse tensile and shear stresses that are sometimes very high.

In order to make it possible to produce the connecting assemblies 6 from a fibrous material, in particular wood, while preventing such stresses leading rapidly to a dangerous failure, the invention proposes subjecting them during their manufacture, before assembly and connection to the structure, to a particular treatment that markedly increases their resistance to the above-mentioned stresses and provides for such use the advantages inherent in the use of wood from the standpoint of cost, ease of machining and aesthetics.

In the example shown in FIGS. 2 to 8, the assembly 6 shown is constituted essentially by two wooden parts 7 and 8 (FIG. 2), presented in the form of two elongate parallelepipedic wooden boards that are identical to each other and square-edged, i.e. each one has sharp edges only. The boards, which are relatively thin and narrow in relation to their length, are arranged symmetrically and parallel to each other with respect to an axis 9. The wood fibres constituting these boards, in the direction of which significant tensile forces can be withstood, in contrast to transverse tensile forces or shear forces, are arranged in the longitudinal direction of this axis.

Arranged with respect to each other in this way, the boards 7 and 8 together form an elongate hollow element 10, with an inner area 11 containing the axis 9, and an outer area 12 on the opposite side.

The boards 7 and 8 of the element 10 forming the assembly 6 moreover have at their two ends, end portions 13 that are preferably exactly identical, each extending between the transverse free end 14 of the board and a preset limit 15, situated at a calculated distance from this tip (FIG. 3).

According to the invention, each of these end portions 13, before the two boards 7 and 8 are connected together in the hollow element 10 and prestressed at the level of this connection as detailed hereinafter, undergoes significant compression, suitable for producing a densification of the fibrous material in the wood, by application of a force exerted on each board perpendicular to its plane in the direction of the axis 9.

Preferably, and as shown in FIG. 4 by the arrows 16 shown therein, the intensity of the compressive force is maximal at the transverse free end 14 of each end portion 13 and minimal at the limit 15, at a distance from said end. Advantageously, the variation of this force along the length of this portion increases while having an even gradient, the resulting compression of the wood similarly varying in a continuous manner in order to give the end portion concerned, viewed in profile, a substantially conical shape, narrower at the end and thicker at a distance.

The compression of the end parts of the wooden boards forming the element 10 and then the resulting densification effect is achieved by any suitable mechanical method, which is immaterial to the invention and therefore not described here in detail, for example using a cylinder that applies to the board, supported by a transverse block, a progressive force deforming the fibrous material between the cylinder and an anvil, particularly by reducing or even eliminating, the cell voids within this material, according to the value of the force exerted. Said densification can also be achieved by injecting a polymer into the wood under increasing pressure, consequently reducing its porosity, and even combining these two procedures.

The element 10, formed of the two wooden boards 7 and 8 the end parts 13 of which have thus been densified and then shaped to present the above-mentioned profile are then connected, as shown in FIG. 5, to an inner connecting member 17, which in the embodiment example shown has the shape of a pyramidal wedge 18, with opposite planar faces 19 and 20, inclined on the longitudinal axis 9 and, in the inner area 11 of the element 10, suitable for entering into close contact with the opposite planar faces 21 and 22 of the two boards, on each side of the longitudinal axis 9, in the corresponding end part.

The pyramidal wedge 18 is arranged so that it can be passed through freely by a tension rod 23, arranged in the direction of the longitudinal axis 9 and comprising at its end situated in the inner area 11 of the element 10, a head 24 forming a stop abutting against the flat face 25 delimiting the rear part of the wedge.

The tension rod 23 is preferably threaded and at its end cooperates with a nut forming the head 24, as shown in the detailed view in FIG. 6. It has a sufficient length to extend beyond the end portions 13 of the boards 7 and 8 at the end of the element 10, once the pyramidal wedge 18 has been positioned therein between the boards, with its two planar faces 19 and 20 in contact with the opposite faces 21 and 22 thereof, after slight bending of the boards in order to make the contact.

The pyramidal wedge 18 is simultaneously associated with a fixed hollow casing 27 (FIG. 5), capable of surrounding the element 10 in its outer area 12 at the level of the end parts 13 of the two boards 7 and 8, the casing thus being immobilized with respect to these two boards after engaging their ends through an open part 28 thereof, suitably shaped to achieve the above-mentioned bending and the close contact between the wedge and the two boards.

Figure 8:
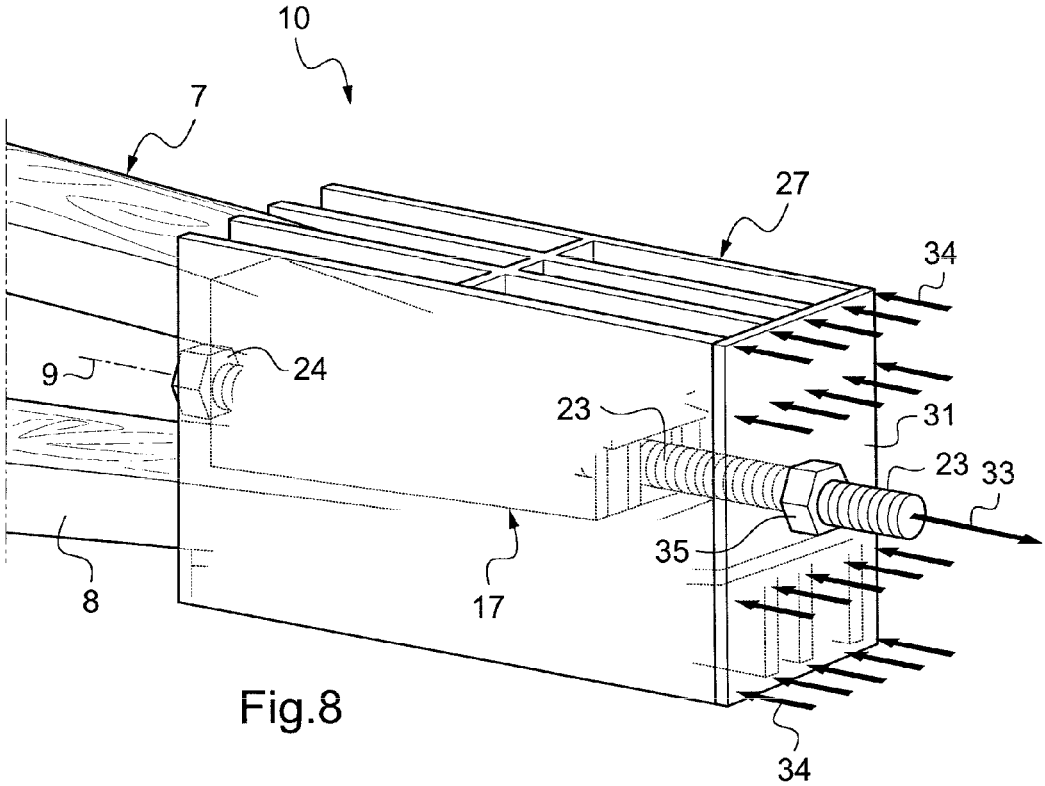

As shown in the larger-scale detailed views in FIGS. 7 and 8, the hollow casing 27 comprises stiffening ribs 29 and 30, extending preferably parallel and perpendicular to the direction of the axis 9, in order to improve the stiffness of the casing, in particular in order to withstand the prestressing force exerted on the assembly according to the invention.

The casing also comprises a base plate 31, extending perpendicular to the longitudinal axis 9 and equipped with a central bore 32 to allow the passage of the end of the tension rod 23 the nut of which, forming the head 24, abuts against the flat face 25 of the pyramidal wedge 18.

Once the parts of the assembly 6 are positioned in this way, an axial force is exerted on the tension rod 23 in the direction of the arrow 33 towards the outside of the element 10, acting to slide the pyramidal wedge 18 forming the inner connecting member 17 in the direction of the axis 9 between the two boards 7 and 8, the latter being conversely immobilized by the fixed casing 27 where they are engaged by their end portions 13, in face to face contact on the wedge 18.

As a result, a prestressing force is created on the corresponding end of the element 10 as a result of the relative movement of the wedge with respect to the casing, shown diagrammatically by the arrows 34 (FIG. 8) applied to this casing in the opposite direction to the tensile force along the arrow 33, this force continuing to increase as necessary, as long as the yield point of the wood under longitudinal tension in the direction of its fibres in particular, which is high, is however not reached.

Once the level of prestressing thus obtained has reached the required level, depending in particular on the stresses to which the assembly will be subjected in use in the supporting structure where it is intended to be installed, the position of the parts is locked, in particular by relative immobilization of the wedge 18 of the connecting member in the inner area with respect to the fixed casing 27 in the outer area, by means of a captive nut 35 on the end of the threaded rod 23 tightened to abut against the base plate 31 of the casing.

Figure 9:
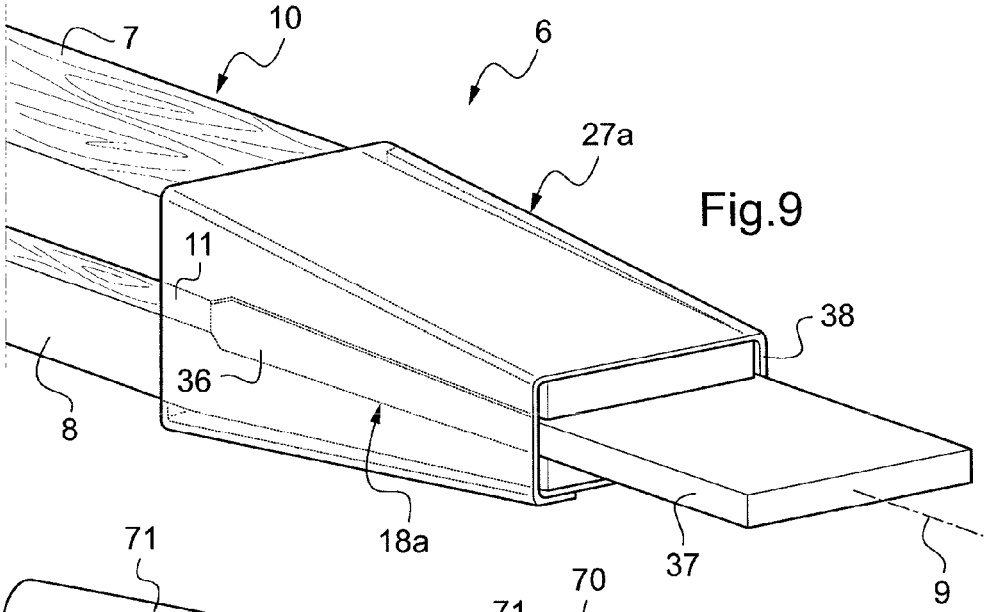

In the variant embodiment shown in the detailed view in FIG. 9, the pyramidal wedge 18*a* constituting the inner connecting member is in the form of a tapered solid metal plate 36, extended beyond the end of the end portions 13 of the element 10 by a tab 37 on which the axial tensile force can be exerted to achieve the prestressing of the two wooden boards 7 and 8 in the manner set out above.

Moreover, the fixed casing 27*a* surrounding the two end portions is here produced using a metal sheet 38, in the form of sleeve open at both ends, this sleeve being capable of being pressed once the level of prestressing is reached, immobilizing the wedge 18*a* in position by a crimping effect of the sheet with respect to the element 10, it then being possible to relax the tensile force exerted on the wedge while retaining the prestressing level attained.

A third embodiment of the assembly according to the invention is shown in FIGS. 10 to 17, where the wooden parts that produce the elongate hollow element are constituted by cylindrical tubes obtained by the so-called "glue-laminated" standard technique, the wood fibres preferably extending parallel to the longitudinal axis of the tube.

Figure 10:
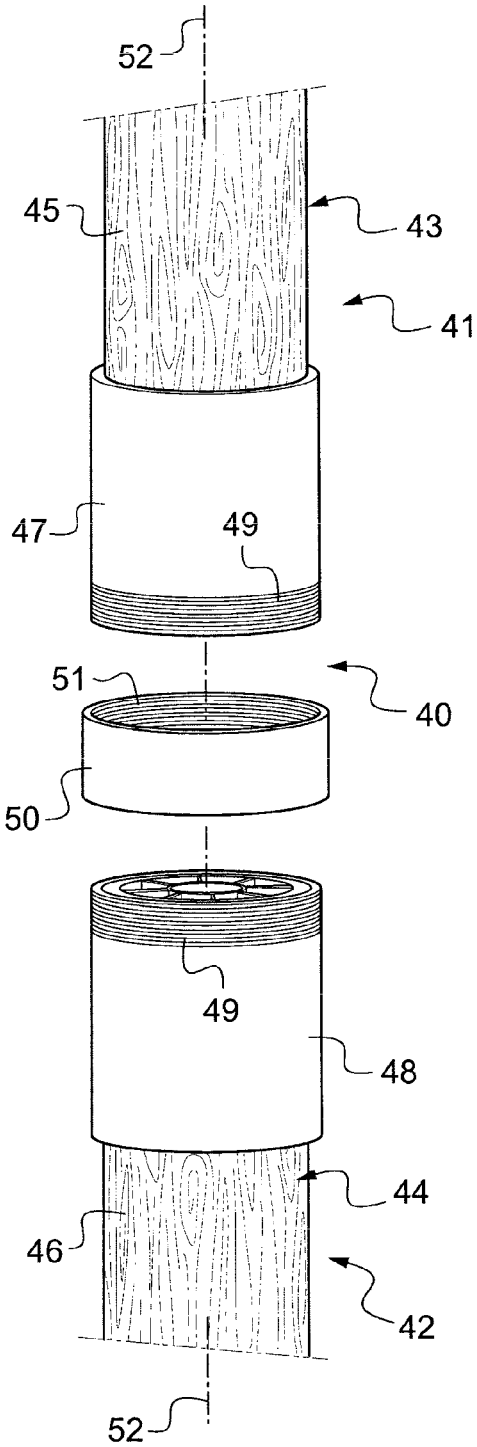
Figure 11:
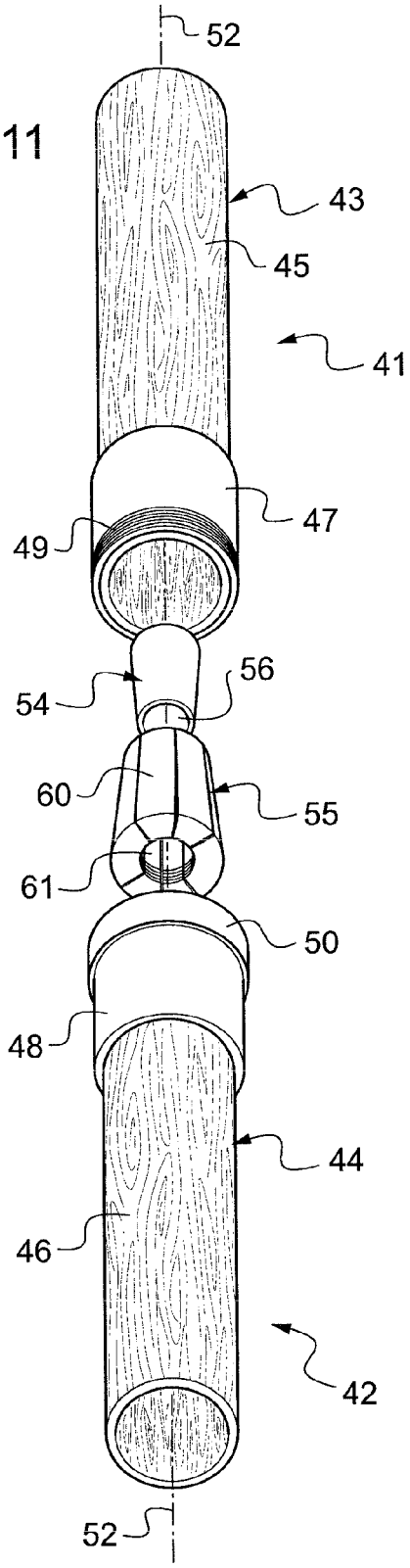

FIG. 10 shows a unit 40, formed using two assemblies 41 and 42, each comprising an elongate hollow element, respectively 43 and 44, constituted by a cylindrical tube, respectively 45 and 46, of the above-mentioned type, the fixed outer casings associated with these hollow elements in order to create, according to the method of the invention, the prestressing force in the end portions of this element, being constituted by metal rings 47 and 48, externally surrounding the two tubes and crimped or otherwise immobilized with respect thereto.

In the example shown, the metal rings 47 and 48 of the tubes 45 and 46 comprise external threading 49, capable of cooperating with a common connecting collar 50, comprising similar internal threading 51 in order to ensure the joining of the two elements 43 and 44, placed end-to-end in line with each other along a common longitudinal axis 52. In a variant embodiment, the connecting collar can be integral with one of the rings and directly provide the connection with the other ring.

According to the invention, each of the end portions 53 of the hollow elements of the two assemblies is previously densified by transverse compression and/or forced injection of a polymer, this previous operation, achieved in the manner already described in relation to the first embodiment previously envisaged, in particular giving this portion a conical profile, progressively narrowing towards the open end of the tube as a result of a compressive force the value of which increases as the distance to said end decreases, as can be seen in the cross-sectional views of the element 43 with partial cutaway, shown in FIGS. 16 and 17.

Figure 12:
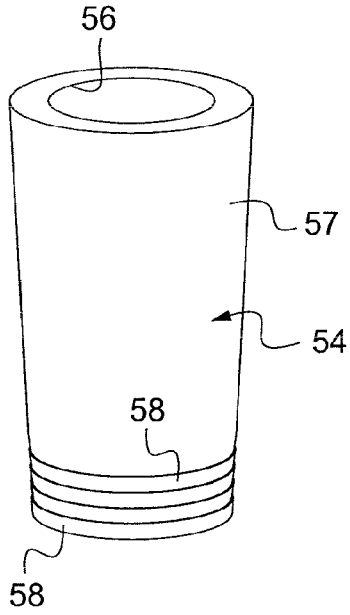
FIGS. 12 to 15 are detailed views showing the design of the stiff wedge and the intermediate sleeve involved in the production of the assembly according to FIGS. 10 and 11.
Figure 13:
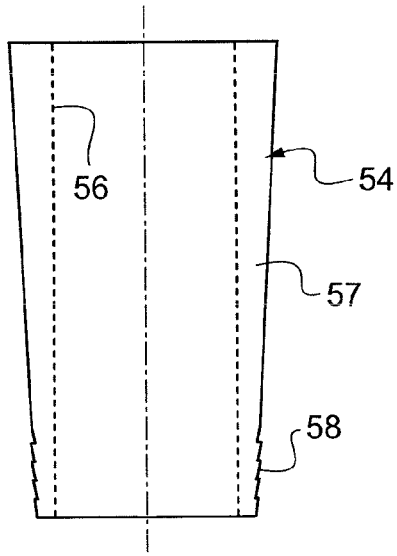

The end part 53 thus made conical in the inner area of the element and held by the metal ring 47 mounted in the outer area, is then subjected to an axial prestressing force, achieved in this example by the use of a connecting member, combining the effect of a stiff wedge 54, having a tapered outer shape and an expandable intermediate sleeve 55, the structure of which is shown in detail in FIGS. 12 and 13 on the one hand and 14 and 15 on the other hand.

The tapered wedge 54, shown in perspective and in axial cross-section in FIGS. 12 and 13 respectively, comprises, arranged along its axis of revolution provided in order to coincide with the longitudinal axis of the tube forming the hollow element when this wedge is used, a cylindrical bore 56, passing through the wedge from one end to the other. Close to its smaller-diameter end, the wedge 54 comprises, arranged in its outer surface 57, successive circular grooves 58, capable of forming notches for locking the position of the wedge relative to the intermediate sleeve, in the manner detailed hereinafter.

Figure 14:
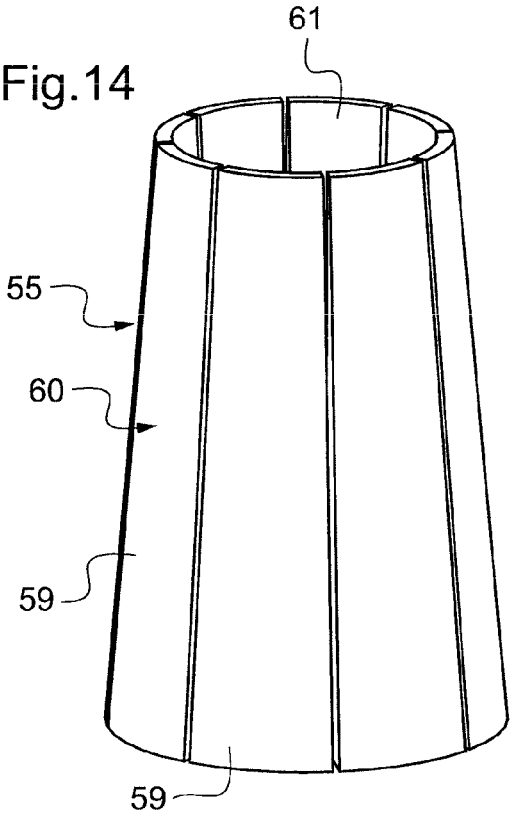
Figure 15:
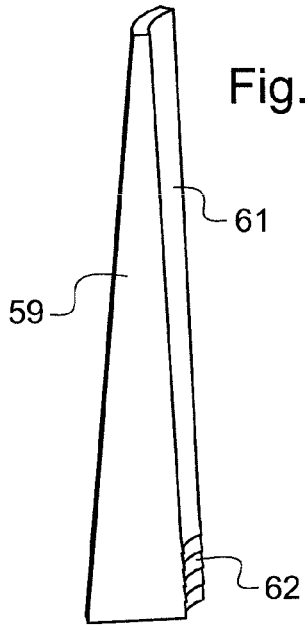

The expandable intermediate sleeve 55 is itself shown in perspective view in FIG. 14. It is constituted by the juxtaposition of a set of adjacent strips 59, one of which is shown in FIG. 15.

Once its various strips 58 are assembled, this sleeve 55 has an outer surface 60, the profile of which is conical and the inclination of which on the longitudinal axis 52 corresponds substantially to that of the end portion 53 of the tube 45 forming the hollow element 43. It comprises an inner cylindrical bore 61, intended to receive the wedge 54 until the latter, after its movement within the tube 45 in the direction of the longitudinal axis, reaches a locking position in which one or more of the circular grooves 58 arranged in the outer surface of the wedge engage with similar grooves 62, made in the adjacent strips 59 of the side of the cylindrical bore 61 of the sleeve 55.

The prestressing of the end portion 53 of the tube 45, outwardly maintained by the metal ring 47, is achieved by sliding the stiff wedge 54 along the longitudinal axis 52 of the tube, in the inner cylindrical bore 61 of the sleeve 55 while creating, owing to the conical profile of the sleeve in its outer surface 60 and the thrust exerted on the adjacent strips 59, a transverse force that increases with the range of this movement until, once the level of prestressing is reached, the wedge locks in position relative to the sleeve and owing to the end portion 53, by cooperation of the respective circular grooves 58 arranged in the outer surface 57 of the wedge and 62 in the inner surface 61 of the sleeve.

The movement under axial tension of the wedge in the sleeve is achieved by any suitable means. In the example in question, advantageously a cylindrical plunger 63 is used, the diameter of which corresponds substantially to that of the bore 56 in the tapered wedge 54, the plunger comprising retractable bearing lugs 64, capable of projecting towards the outside of the plunger in order to abut against the top of the wedge in order to allow it to drive the latter inside the sleeve 55 in the direction of the axis 52 in order to achieve the prestressing of the end portion of the tube in the manner indicated above.

Once the wedge 54 and the sleeve 55 are locked together by cooperation of their grooves 58 and 62, the bearing lugs 64 can be retracted, allowing the plunger 63 to slide freely back in the bore 56 and to be extracted from the hollow element 43 without altering the level of prestressing achieved.

Yet another embodiment, shown in FIGS. 18 to 21, is applicable more particularly to producing an assembly in which the elongate hollow element is constituted by a bamboo tube.

Figure 18:
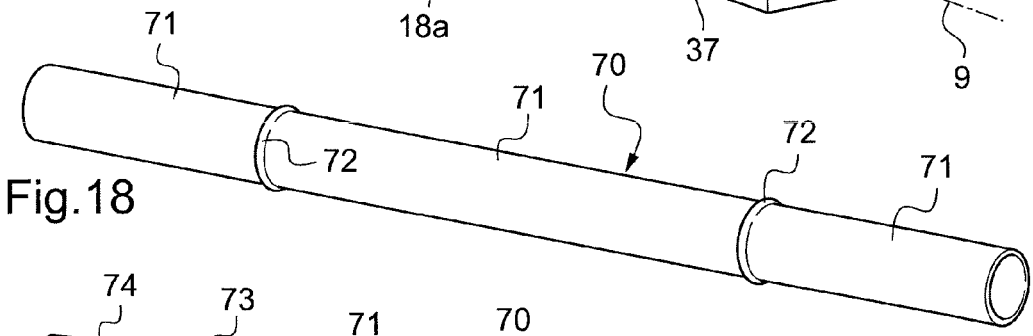
FIGS. 18 to 21 show, with the parts involved shown separately then together, another embodiment of the hollow element of the assembly, more specifically adapted to the case where the element is constituted by a bamboo tube.

Such a tube or culm is shown in FIG. 18, said tube 70 being formed from successive sections 71, each separated from the one following by a knot 72.

Figure 19:
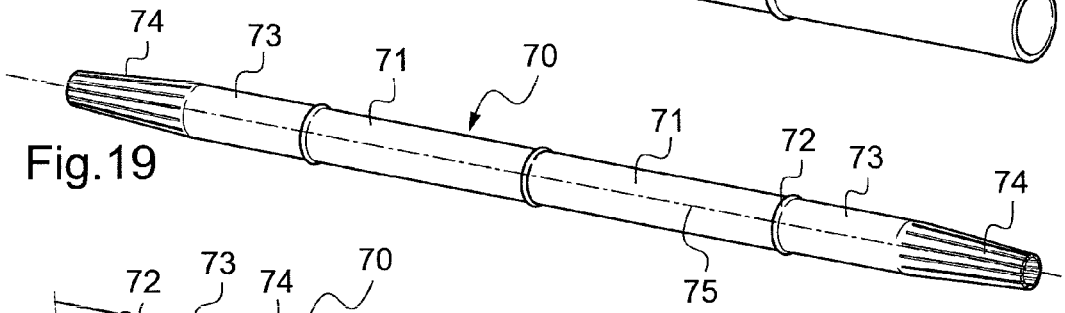

Each end portion 73 of the tube 70, to be densified and prestressed axially according to the invention, is firstly made conical by making slits 74 therein, preferably evenly distributed over its circumference, these slits making it possible to significantly taper the bamboo towards the axis 75 of this tube, as shown in FIG. 19, giving it a suitable conical profile.

Figure 20:
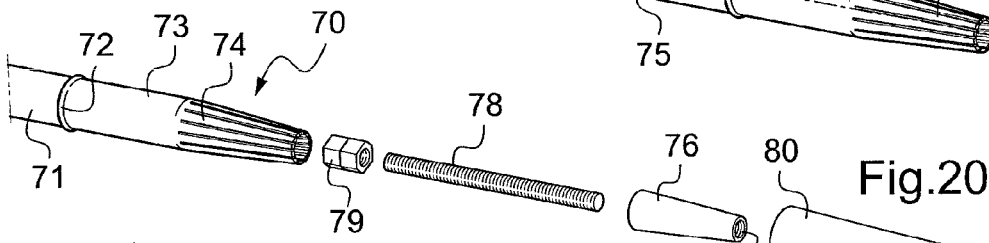
Figure 21:
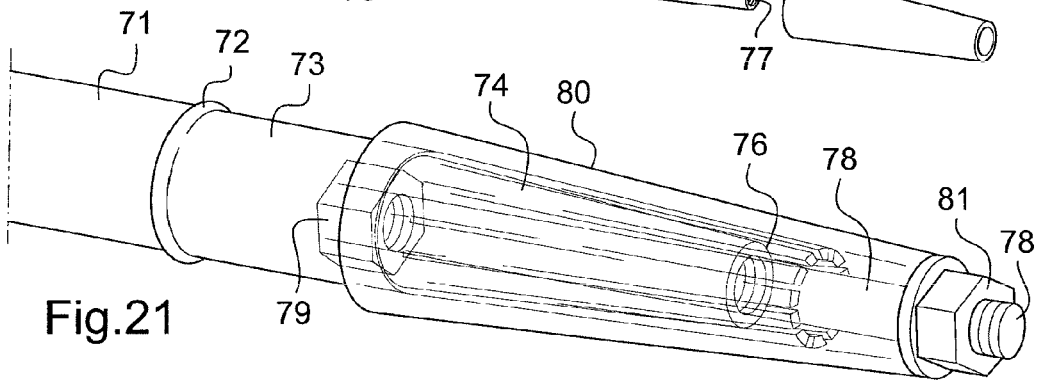

The prestressing force is then created by using, as in the first embodiment described above, a cone-shaped inner connecting member 76, passed through by a central bore 77 allowing the passage of a threaded rod 78, a nut 79 fixed at the end of the rod and forming a stop abutting against the cone and a fixed outer casing 80, also conical in shape, capable of surrounding and immobilizing the corresponding end portion 73 from the outside, as shown in exploded view in FIG. 20 and on a larger scale in perspective in FIG. 21.

In the latter, the threaded rod 78 cooperates with an outer locking nut 81, once the level of prestressing is reached.

The invention thus proposes a method for producing assemblies of parts made of wood or another similar fibrous material, which makes it possible, while benefiting from the aesthetic aspects generally provided by the use of this material in many fields such as building, civil engineering, street furniture, furnishings, etc., to remove in a particularly effective way, the causes of failure brought about in the areas of connection between the parts of this assembly or neighbouring assemblies connected to the previous one, owing to the fragility of this material in certain directions, by the members providing this connection, in particular with respect to transverse tensile and shear forces created in these parts during installation of these members.

The method envisaged more particularly ensures that said connecting areas are no longer the weak point of structures using such assemblies, ensuring their maximum load level without risk of displacement or splitting, these assemblies moreover having an improved ductility and thus a significant energy dissipation capacity, in particular in the case of accidental impacts or shaking in an earthquake situation in particular.

The assemblies thus created use all the natural strength of the fibrous material under longitudinal tension, without the connecting members introducing any parasitic stresses in this direction. On the other hand, the densification and prestressing of the parts used considerably increase their stiffness and their shear strength, which also reduces movement induced in the structures themselves.

Of course, it goes without saying that the embodiments more particularly described above and shown in the attached drawings cannot in themselves limit the scope of the following claims which, on the contrary, encompass all variant embodiments.

In particular, in these various examples, the prestressed element of the assembly, formed from two square-edged timbers or boards made of wood or from a tubular element, also of wood or bamboo, is hollow over its entire length. It is possible however, without exceeding the scope of the invention, to use essentially solid elements, only hollowed or split at their end parts in order to install therein the wedge-type or other type of parts that are suitable for prestressing the element at these end parts.

The invention claimed is:

1. Method for manufacturing an assembly capable of use in the production of a supporting structure, said assembly being constituted by parts (7,8) made of a fibrous material forming an elongate element that is at least partially hollow (10), with a longitudinal axis of symmetry (9), delimiting an inner area (11) and an outer area (12), characterized in that it consists of producing a localized densification of the fibrous material on the two end portions (13) of the elongate hollow element, in order to exert, simultaneously with or following this densification, on each of the two end portions of the elongate hollow element, outward tensile forces in opposite directions to each other along its longitudinal axis in order to create an axial prestressing force having a determined value, and to maintain the elongate hollow element in this prestressed condition during the installation of the assembly in the structure.

2. Method according to claim 1, characterized in that the densification of the fibrous material is achieved according to a mechanical process capable of reducing or even removing the cell voids in the material, obtained by means of a radial compressive force exerted on each of the two end portions of the elongate hollow element, in a direction perpendicular to its longitudinal axis.

3. Method according to claim 2, characterized in that the compressive force exerted varies in its intensity according to the length of each end portion (13), being maximal at the free end (14) of the elongate hollow element and minimal at a distance (15) therefrom, according to the length of this portion.

4. Method according to claim 2, characterized in that the compressive force exerted has a gradient that increases evenly along the length of each end portion (13) of the hollow element.

5. Method according to claim 1, characterized in that the densification of the fibrous material is achieved by reducing its porosity following the forced injection of a polymer or another similar substance into this material in each of the two end portions of the elongate hollow element.

6. Method according to claim 1, characterized in that the densification of the fibrous material is achieved by combining a compressive force and the injection of a polymer.

7. Method according to claim 1, characterized in that the prestressing force in each of the end portions (13) of the elongate hollow element is achieved by placing on the one hand an inner connecting member (18), having a generally conical shape, in close contact with the elongate hollow element in the inner area (11), said member being firmly fixed using means (23,24) suitable for exerting an outward tensile force along the longitudinal axis of the element and on the other hand, a fixed hollow casing (27), surrounding the element in its outer area while being immobilized with respect thereto, such that the longitudinal movement of the inner connecting member in the inner area, under the effect of the axial tensile force, by cooperation with the fixed casing in the outer area creates an increasing prestressing of the fibrous material that becomes greater with this force, the mutual locking of the connecting member relative to the casing then being provided in order to maintain the prestressing at its value thus obtained.

8. Assembly produced by use of the method according to claim 1, characterized in that the elongate hollow element (10), made of fibrous material uses two square-edged parts (7,8), in the form of identical planar wooden boards or battens, spaced apart, substantially parallel to each other over the greater part of their length and symmetrical with each other with respect to the longitudinal axis (9) of the element, the end portions (13) of said two boards being brought towards each other and each having a preferably progressive narrowing owing to the force exerted on these portions in order to achieve their densification by mechanical compression and/or forced injection of a polymer, the inner connecting member (18) having the form of a pyramidal wedge, cooperating with a tension rod (23), arranged along the longitudinal axis of the element in order to allow the prestressing force to be exerted on the wedge, the pyramidal wedge comprising two opposite planar faces (19,20) in contact with the opposite faces of the end portions of the two boards directed towards the inner area, the fixed hollow casing (27), surrounding the end portions of the two boards in the outer area, comprising an open end (28) for inserting the element and a base plate (31), opposite the open end, closing the casing at the tip of its end portions.

9. Assembly according to claim 8, characterized in that the base plate (31) of the casing (27) has a bore (32) in the longitudinal axis (9) of the element for the tension rod (23) of the pyramidal wedge (18) to pass through.

10. Assembly according to claim 8, characterized in that the end of the tension rod (23) is threaded and cooperates with a nut (35) locking the casing relative to the pyramidal wedge (18) in order to maintain the prestressing created on the assembly as a result of the tensile force exerted on said wedge along the longitudinal axis (9) of the element (10).

11. Assembly according to claim 8, characterized in that the fixed casing (27) comprises, on its inner surface in contact with the faces of the end portions (13) of the two boards (7,8) of the element (10) directed towards the outer area, stiffening ribs (29,30), extending parallel to the longitudinal axis of the element.

12. Assembly according to claim 10, characterized in that the hollow casing (27*a*) is produced using a metal sheet (38), shaped to surround the end portions of the two boards of the element (10), suitable for pressing externally in order to crimp it with respect to the pyramidal wedge (18*a*) forming the inner connecting member, in order to maintain the prestressing created on the assembly.

13. Assembly produced according to the method in claim 1, characterized in that the elongate hollow element (43) is constituted by a wooden tube, preferably obtained according to the so-called "glue-laminated" technique, having end portions (53) previously densified by mechanical compression and/or forced injection of a polymer, the inner connecting member being constituted by a stiff wedge (54) having a conical or tapered shape, with an axial through-hole (56), this wedge being capable of engagement and movement along the longitudinal axis (52) of the element in the cylindrical bore (61) of a radially expandable intermediate sleeve (55) and of being forced into the latter in order to create the prestressing force exerted on the end portions of the wooden tube, the fixed casing being formed of a metal ring (47) outwardly surrounding the tube on the end portions.

14. Assembly according to claim 13, characterized in that the radially expandable intermediate sleeve (55) is formed from independent adjacent strips (59), delimiting the cylindrical bore (61) of said sleeve and suitable for radial expansion under the effect of the movement of the stiff wedge (54) in the cylindrical bore along the longitudinal axis (52) of the element (43), creating the prestressing force.

15. Assembly according to claim 13, characterized in that the end of the conical wedge (54) comprises circular grooves (58), arranged in its outer surface (60) in planes perpendicular to the longitudinal axis (52), these grooves forming successive notches for locking this wedge relative to the intermediate sleeve (55) by cooperating with similar grooves (62) provided in the adjacent strips (59) of the sleeve opposite the wedge.

16. Assembly according to claim 13, characterized in that the movement of the conical wedge (54) in the intermediate sleeve is produced by means of a cylindrical plunger (63), capable of sliding in the axial through-hole (56) of the wedge (54) and comprising at the end bearing lugs (64) suitable for exerting an axial force on this wedge, causing the prestressing of the end portions of the tube by engagement of the wedge in the radially expandable sleeve.

17. Assembly according to claim 16, characterized in that the lugs (64) of the plunger (63) can be retracted within it, in order to allow it to be withdrawn from the wedge, after the prestressing force has been achieved.

18. Assembly according to claim 13, characterized in that the metal ring (47) forming the fixed outer casing usefully comprises a threaded end (49) forming a screw, suitable for cooperating with a similar threading (51), forming a nut, provided in an adjacent tube (44), arranged in the longitudinal axis of the hollow tube of the element (43) by connecting the two tubes in the assembly.

19. Assembly produced according to the method of claim 1, characterized in that the elongate hollow element is constituted by a bamboo tube (70), the end portions (74) of which are split longitudinally and significantly tapered, in order to give the tube in these portions a conical shape where the bamboo is densified; the prestressing of the tube being achieved, preferably simultaneously with the densification, by the cooperation of a conical wedge (76) engaged in the inner area of the element at the level of each end portion, and a fixed outer casing (80), also conical, surrounding the end portion, the wedge comprising an axial tension rod (78) suitable for creating the prestressing force in the bamboo tube while simultaneously increasing its densification.

20. Supporting structure in which the connecting assemblies are produced in accordance with the method according to claim 1.

21. Supporting structure using an assembly according to claim 8.

* * * * *

UNITED STATES PATENT AND TRADEMARK OFFICE

CERTIFICATE OF CORRECTION

PATENT NO. : 8,650,820 B2
APPLICATION NO. : 13/378915
DATED : February 18, 2014
INVENTOR(S) : Bocquet et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 234 days.

Signed and Sealed this
Twenty-ninth Day of September, 2015

Michelle K. Lee

Michelle K. Lee
*Director of the United States Patent and Trademark Office*